US007445402B1

(12) United States Patent
Chen

(10) Patent No.: US 7,445,402 B1
(45) Date of Patent: Nov. 4, 2008

(54) BARRIER PLATE FOR HIGHWAYS

(75) Inventor: Chih-Hung Chen, 3F., No. 490-3, Sinfong St., Jhongjheng District, Keelung City 202 (TW)

(73) Assignees: Chih-Hung Chen, Keelung (TW); Kuo-Liang Su, Taipei (TW)

( * ) Notice: Subject to any disclaimer, the term of this patent is extended or adjusted under 35 U.S.C. 154(b) by 0 days.

(21) Appl. No.: 11/958,441

(22) Filed: Dec. 18, 2007

(51) Int. Cl.
*E01F 13/00* (2006.01)
*E01F 15/00* (2006.01)

(52) U.S. Cl. ..... 404/6; 404/9; 256/13.1

(58) Field of Classification Search ..... 404/6, 404/9–11; 256/13.1
See application file for complete search history.

(56) References Cited

U.S. PATENT DOCUMENTS 3,493,213 A * 2/1970 Ackerman ..... 256/13.1
4,138,093 A * 2/1979 Meinzer ..... 256/13.1
4,681,302 A * 7/1987 Thompson ..... 256/13.1
5,490,661 A * 2/1996 Stevens et al. ..... 256/13.1
5,507,473 A * 4/1996 Hammer et al. ..... 256/13.1
6,007,269 A * 12/1999 Marinelli ..... 404/6
6,010,275 A * 1/2000 Fitch ..... 404/6
6,149,134 A * 11/2000 Bank et al. ..... 256/13.1
6,168,346 B1 * 1/2001 Ernsberger ..... 404/6
6,308,936 B1 * 10/2001 Atwood ..... 256/13.1
7,220,077 B2 * 5/2007 Humphries et al. ..... 404/6
2002/0053664 A1 * 5/2002 Moore ..... 256/13.1
2004/0234334 A1 * 11/2004 King ..... 404/6

* cited by examiner

*Primary Examiner*—Raymond W Addie
(74) *Attorney, Agent, or Firm*—Alan Kamrath; Kamrath & Associates PA

(57) ABSTRACT

A barrier plate for highways comprises a M-shaped protective member made of plastic material and integrally press formed, and including a plurality of trapezoid and spaced projections and concaved planes, each of the projections having integrally formed and spaced first, second and third passages formed in the inner rim thereof and having a warning structure affixed on the outer periphery thereof; a saddle, one side of which is joined with the M-shaped protective member by using a trapezoid elongated retaining portion, made of ABS plastic material and injection molded in the shape of a flat lamination, and including a plurality of corresponding bores provided on one side thereof and a recessed adhesive portion formed on another side thereof; a support, one end of which is inserted in the ground yet another end of which cooperates with the adhesive portion of the saddle, retained by bolts through the M-shaped protective member.

10 Claims, 9 Drawing Sheets

BARRIER PLATE FOR HIGHWAYS

BACKGROUND OF THE INVENTION

1. Field of the Invention

The present invention relates to a barrier structure, and more particularly to a barrier plate for highways that has high flexibility, rigidity, weathering, anti-erosion, and lightweight so as to enhance protective function, and may provide warning and guiding effect by attaching reflective elements thereon.

2. Description of the Prior Arts

Conventional barrier for highways is generally made of metal in a punching manner and may cooperate with cement columns to form elongated continuous protection structures. Since the barrier for highways made of metal is hard and lacks flexibility, a great shock can not be effectively absorbed while a car crashes it, lowering protective effect. Moreover, in recycling process, the damaged barrier can not be reproduced due to its hardness. Although the warning structure of the conventional barrier includes reflective paints painted thereon, it will peel off easily after repeated use, decreasing warning and guiding function. Likewise, because the government is short of sufficient budget, the conventional optronics facilities on highways, e.g., power supply, power line, can not be constructed completely, resulting in deficient illumination and communication equipments. What is worse if some emergency situations happen, maydays will be accordingly delayed. The prior art barrier for highways is always designed in a single color manner, having a dull appearance.

The present invention has arisen to mitigate and/or obviate the afore-described disadvantages.

SUMMARY OF THE INVENTION

The primary object of the present invention is to provide a barrier plate for highways that may be recycled and decrease reconstruction cost.

The secondary object of the present invention is to provide a barrier plate for highways that may enhance aesthetic appearance and beautify environment.

A further object of the present invention is to provide a barrier plate for highways that may prevent a car from downfall on the specific highways or mountain roads.

Another object of the present invention is to provide a barrier plate for highways that may save construction costs of optronics facilities on the highways.

Still a further object of the present invention is to provide a barrier plate for highways that may cause an illuminating and warning effect.

Also, another object of the present invention is to provide a barrier plate for highways that may generate an illuminating and guiding function.

In accordance with one aspect of the present invention, there is provided a barrier plate for highways comprising an M-shaped protective member, a saddle, and a support.

The M-shaped protective member is made of plastic material and integrally press formed, having preferred flexibility, rigidity, weathering, anti-erosion, and lightweight, such that obtaining a recyclable purpose so as to save reconstruction cost. During the press forming process of the M-shaped protective member, a variety of colors and composite materials are added therein so as to achieve color changeable and environment beautifying effect. Furthermore, the M-shaped protective member includes a plurality of trapezoid and spaced projections and concaved planes, each of the projections has holes corresponding to each other and arranged at the predetermined positions thereof, and has integrally formed and spaced first, second and third passages formed in the inner rim thereof, respectively. The first passage may be provided to receive a high tensile cord for enhancing resistance or to receive a tubular member in which the high tensile cord is inserted, improving protective and barrier function on the specific highways and mountain roads so as to prevent a car from downfall. The second and third passages are provided to receive an optical fiber of communication/network and a power line individually so as to acquire power supply of instant messaging and automatic warning, lowering construction costs of optronics facilities on the highways. Also, each of the projections includes a warning structure affixed on the outer periphery thereof and having an adhesive warning tape attached thereon, wherein a reflective agent may be replaceably applied thereon or a reflective sheet may be replaceably inlaid thereon. The warning structure further has a LED light set and a LED illumination set attached onto the joining portion of the M-shaped protective member and the support. The LED light set and the LED illumination set may be utilized to be a reflective sign or a reflective marking line in different distance arrangement. Two ends of the M-shaped protective member may be constructed in the form of a semicircle, enhancing safety and aesthetic appearance.

The saddle is made of ABS plastic material and injection molded in the shape of a flat lamination, and one side thereof is joined with the M-shaped protective member by way of a trapezoid elongated retaining portion by which the LED light set or the LED illumination set is affixed, and the saddle includes a plurality of corresponding bores provided on one side thereof and a recessed adhesive portion formed on another side thereof.

The support, one end of which is inserted in the ground yet another end of which cooperates with the adhesive portion of the saddle, is retained by passing bolts through the M-shaped protective member. In addition, the support includes two semicircular clamping seats for eliminating its deformation or for easy replacement after damage.

The M-shaped protective member, the saddle, and the support are assembled together in turn so as to complete an illuminative and warning barrier plate for use in highways. For use on specific highways or mountain roads, the tubular member is inserted into the M-shape protective member and includes a number of perforated openings and an intersected slot arranged therearound so as to align the holes with the intersected slot by means of a crossed retainer, finishing the assembly.

In another embodiment of the present invention, the support is vertically inserted in the ground and then is affixed by using the clamping seats. Thereafter, the M-shape protective member is assembled onto the support by virtue of the saddle and multiple screws, finishing a successive elongated barrier structure, head and distal ends of which are twisted in the shape of a semicircle, obtaining an anti-collision and shock-absorbing purpose. On the other hand, the adhesive warning tape of the warning structure may reflect light in dark conditions, achieving an illuminating and guiding purpose. At the joining portion of the M-shaped protective member and the support are arranged the LED light set and the LED illumination set of the warning structure, generating an illuminating and warning effect.

Besides, the power of the LED light set or the LED illumination set is supplied through the power line in the third passage of the M-shaped protective member. It is to be noted that the power line may be also applied with small solar energy equipment, saving electricity.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
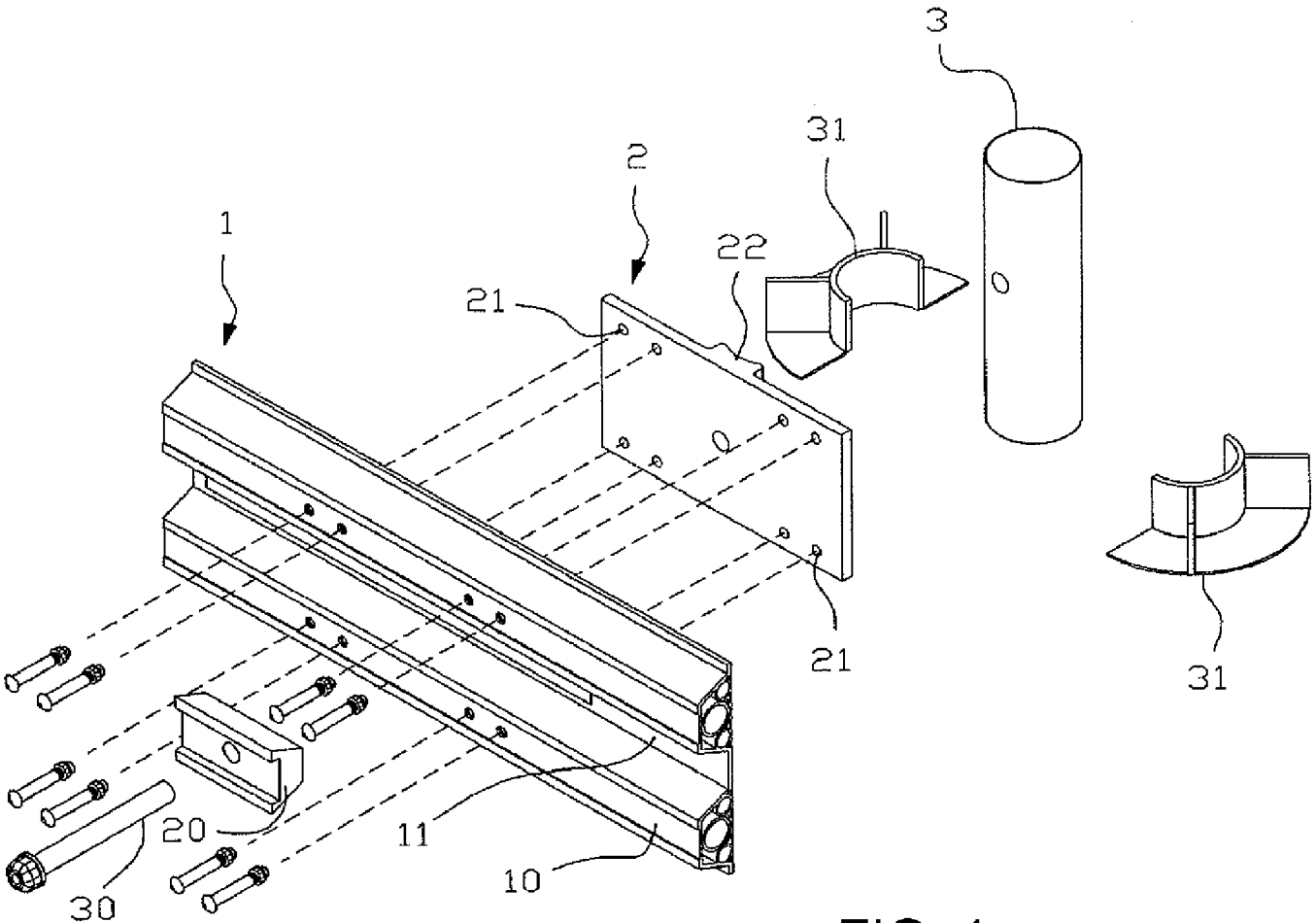
FIG. 1 is a perspective diagram illustrating the exploded components of a barrier plate for highways according to the present invention.

Referring to FIG. 1, a barrier plate for highways in accordance with the present invention at least comprises an M-shaped protective member 1, a saddle 2, and a support 3.

Figure 2:
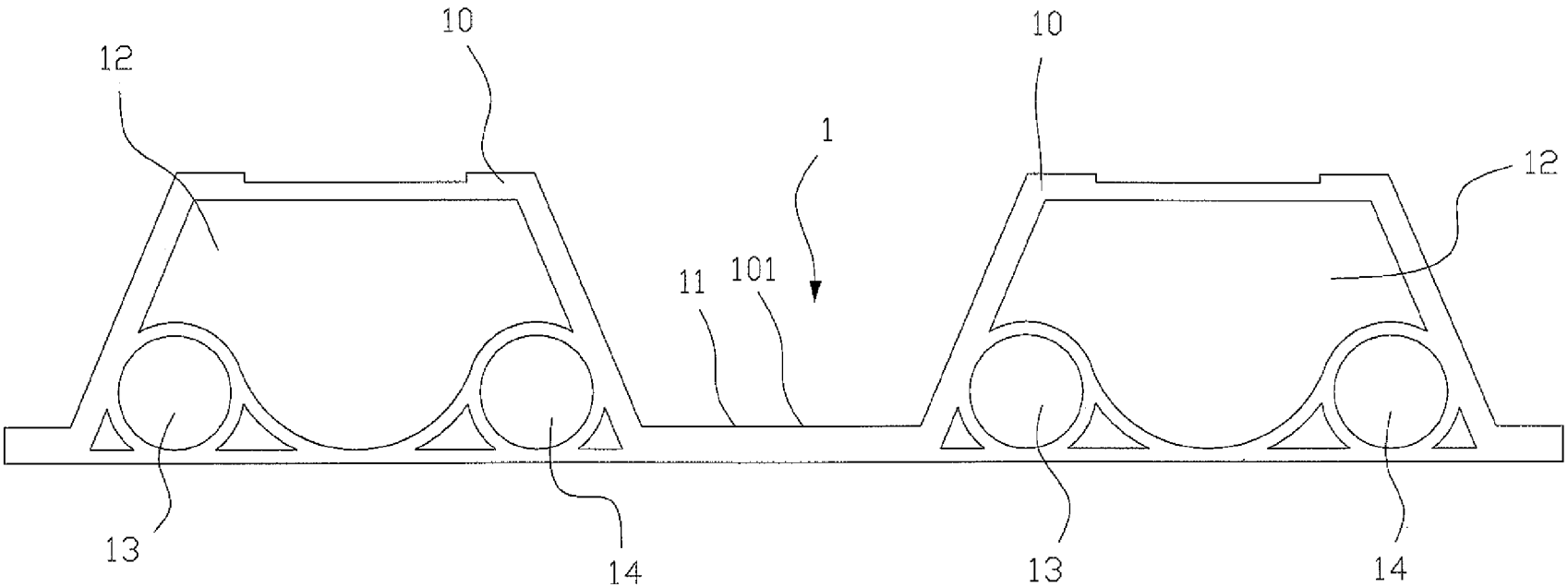
FIG. 2 is a cross sectional diagram illustrating the assembly of a M-shaped protective member according to the present invention.
Figure 3:
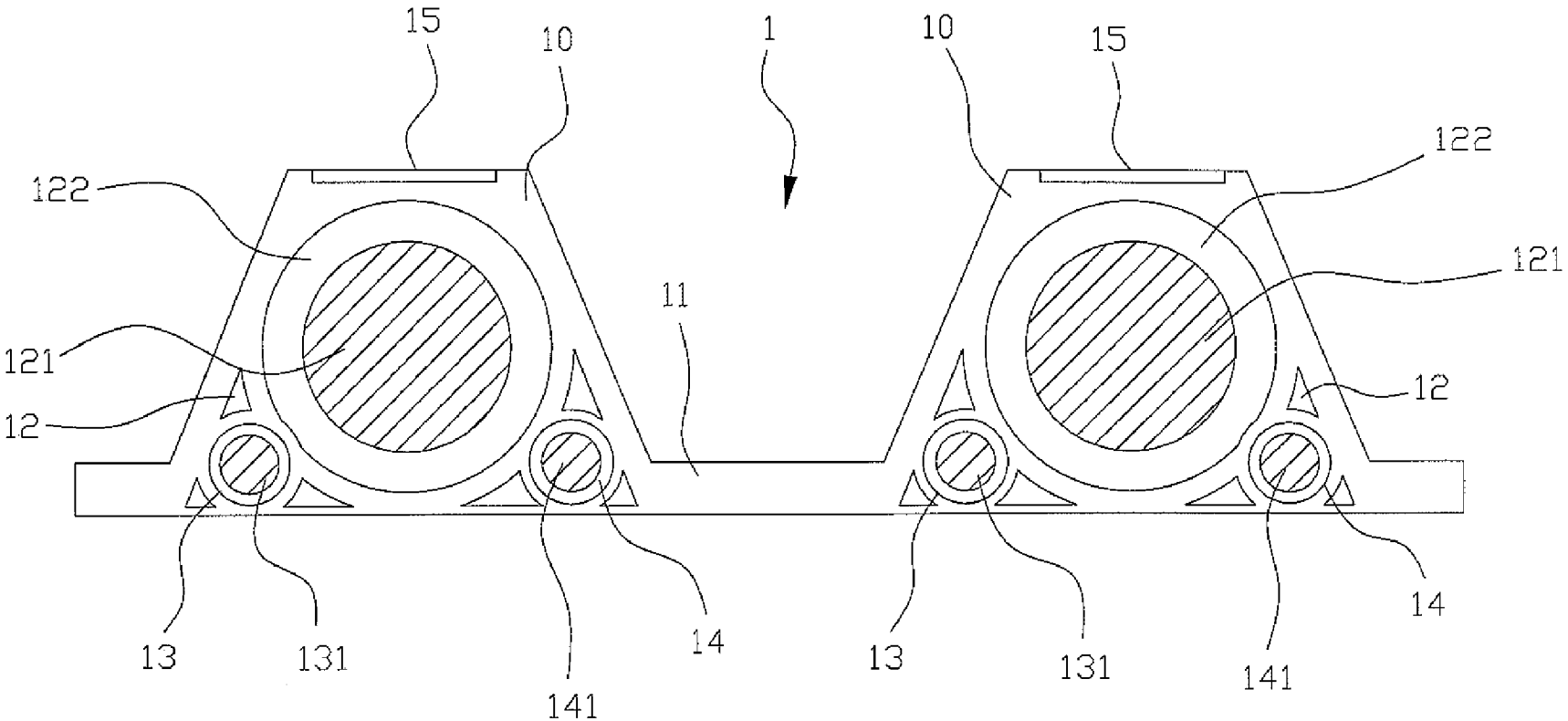
FIG. 3 is a cross sectional diagram illustrating the operation of the M-shaped protective member according to the present invention.
Figure 4:
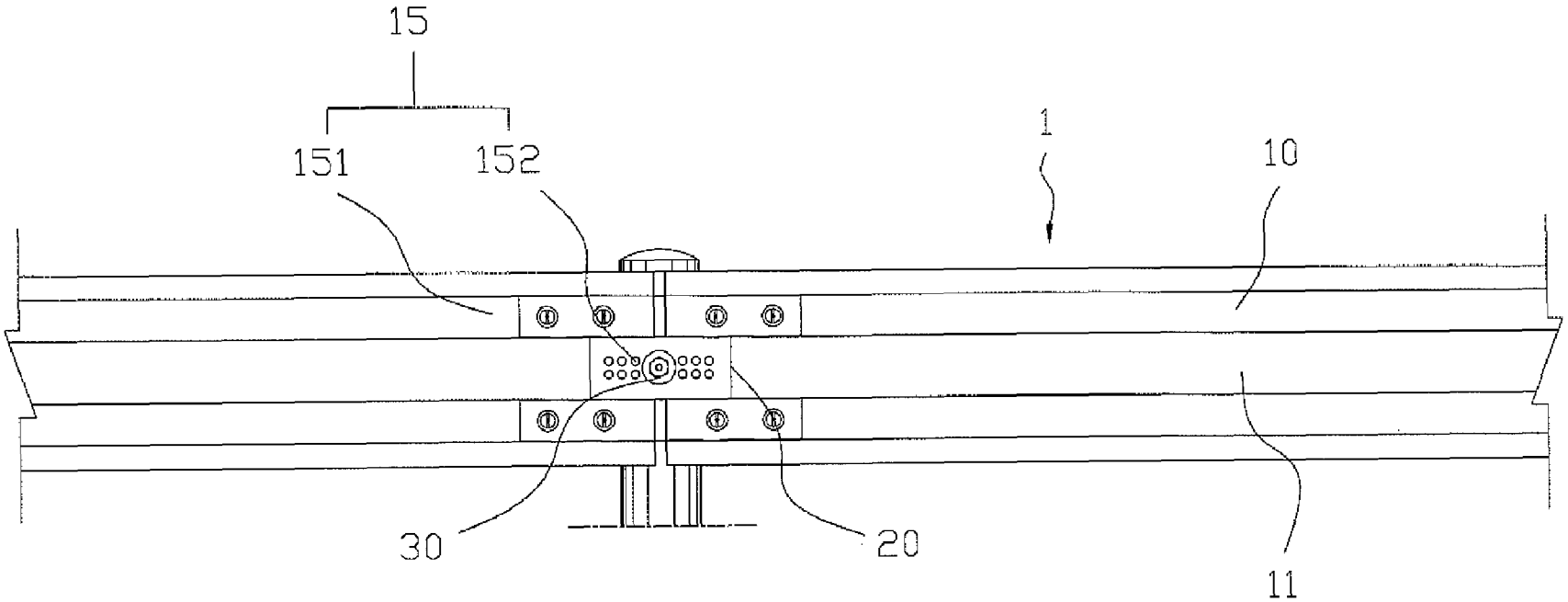
FIG. 4 is a plan diagram illustrating the assembly of a warning structure of the M-shaped protective member according to the present invention.
Figure 4A:
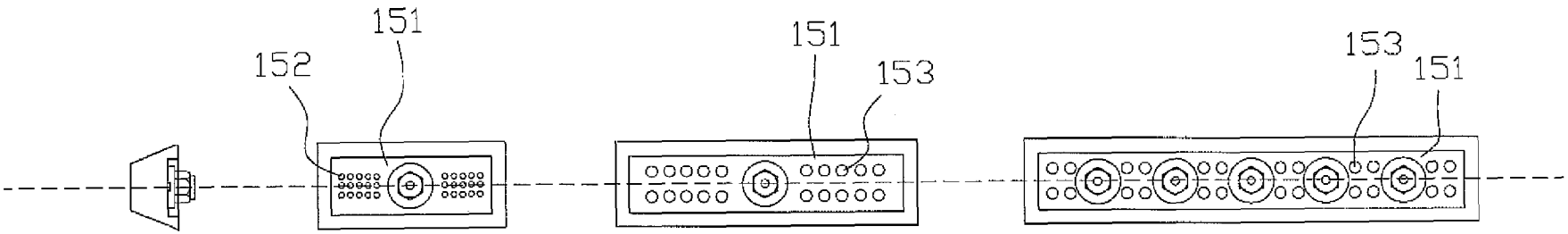
FIG. 4A is a plan diagram illustrating different LED light and illumination sets of the warning structure of the M-shaped protective member according to the present invention.
Figure 5:
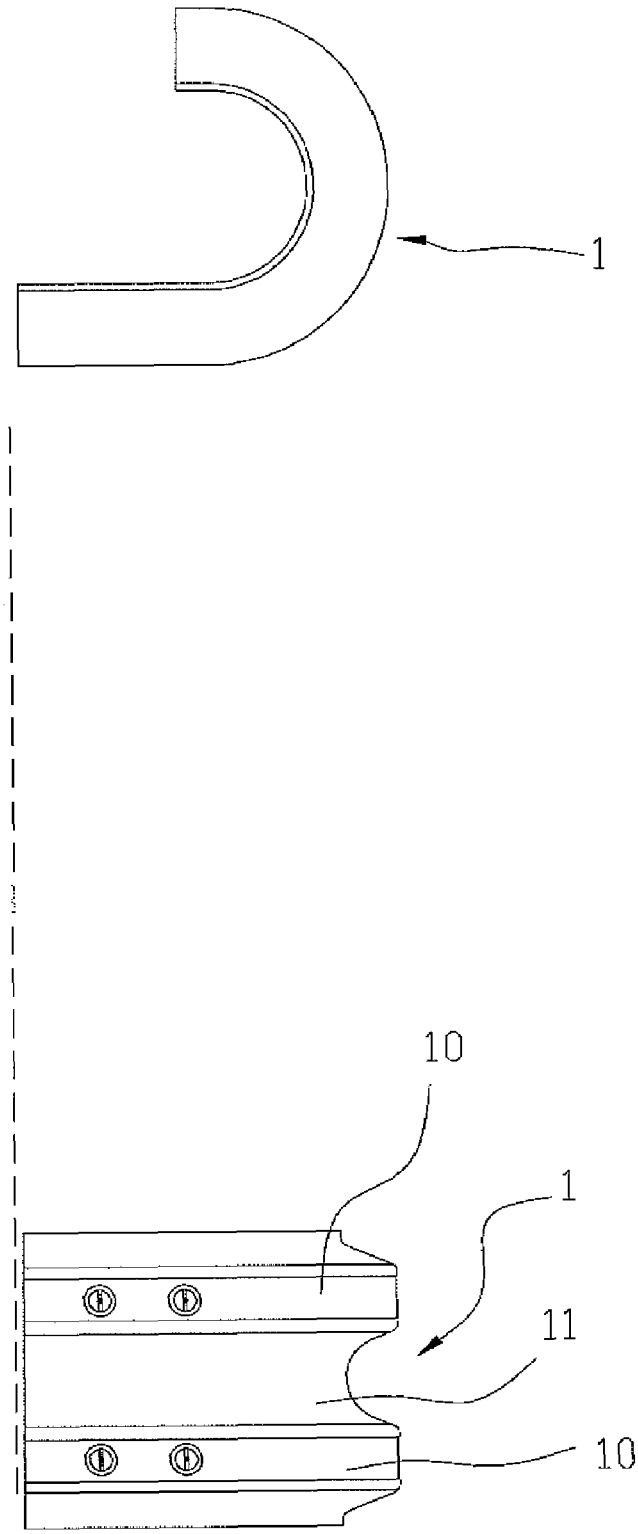
FIG. 5 is a plan diagram illustrating one end of the M-shaped protective member of the present invention being twisted in the shape of a semicircle.

As illustrated in FIG. 2, the M-shaped protective member 1 is made of plastic material and integrally press formed, having preferred flexibility, rigidity, weathering, anti-erosion, and lightweight, such that obtaining a recyclable purpose so as to lower reconstruction cost. During the press forming process of the M-shaped protective member 1, a variety of colors and composite materials are added therein so as to achieve color changeable and environment beautifying effect. Furthermore, the M-shaped protective member 1 includes a plurality of trapezoid and spaced projections 10 and concaved planes 11, each of the projections 10 has holes 101 corresponding to each other and arranged at the predetermined positions thereof, and has integrally formed and spaced first, second and third passages 12, 13, 14 formed in the inner rim thereof, respectively. As shown in FIG. 3, the first passage 12 may be provided to receive a high tensile cord 121 for enhancing resistance or to receive a tubular member 122 in which the high tensile cord 121 is inserted, improving protective and barrier effect on the specific highways and mountain roads so as to prevent car crashes. The second and third passages 13, 14 are provided to receive an optical fiber 131 of communication/network and a power line 141 individually so as to acquire power supply of instant messaging and automatic warning, lowering construction costs of optronics facilities on the highways. Referring further to FIG. 4, each of the projections 10 includes a warning structure 15 affixed on the outer periphery thereof and having an adhesive warning tape 151 attached thereon, wherein a reflective agent may be replaceably applied thereon or a reflective sheet may be replaceably inlaid thereon. The warning structure 15 further has a LED light set 152 and a LED illumination set 153 attached onto the joining portion of the M-shaped protective member 1 and the support 3. As illustrated in FIG. 4A, the LED light set 152 and the LED illumination set 153 may be utilized to be a reflective sign or a reflective marking line in different distance arrangement. Referring further to FIG. 5, the two ends thereof of the M-shaped protective member 1 may be constructed in the form of a semicircle, enhancing safety and aesthetic appearance.

As shown in FIG. 1, the saddle 2 is made of ABS plastic material and injection molded in the shape of a flat lamination, and one side thereof is joined with the M-shaped protective member 1 by way of a trapezoid elongated retaining portion 20 by which the LED light set 152 or the LED illumination set 153 is affixed, and the saddle 2 includes a plurality of corresponding bores 21 provided on one side thereof and a recessed adhesive portion 22 formed on another side thereof.

As shown in FIG. 1, the support 3, one end of which is inserted in the ground yet another end of which cooperates with the adhesive portion 22 of the saddle 2, is retained by passing bolts 30 through the M-shaped protective member 1. In addition, the support 3 includes two semicircular clamping seats 31 for eliminating its deformation or for easy replacement after damage.

Figure 6:
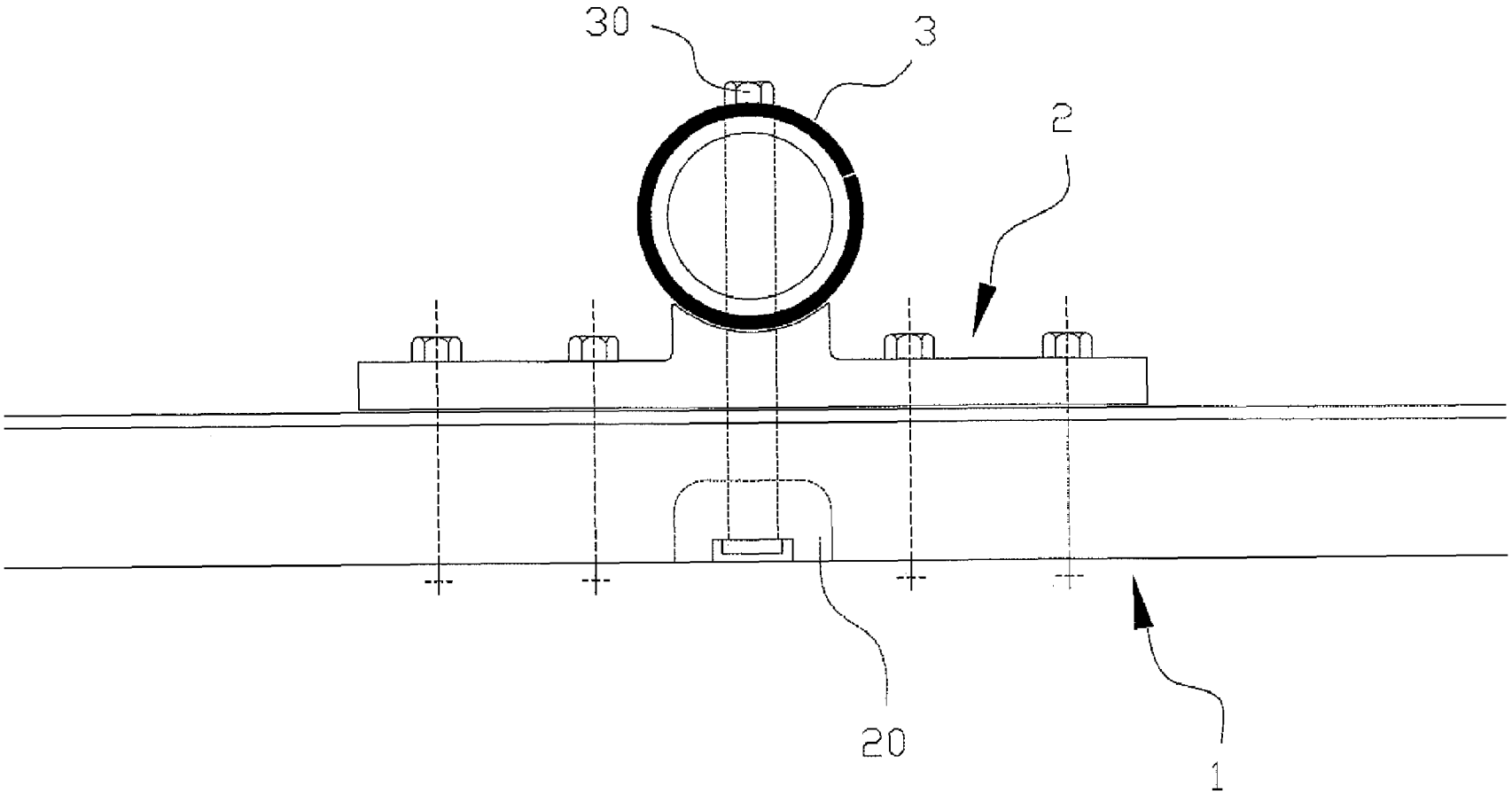
FIG. 6 is a cross sectional diagram illustrating the assembly of the barrier plate for highways according to the present invention.
Figure 6A:
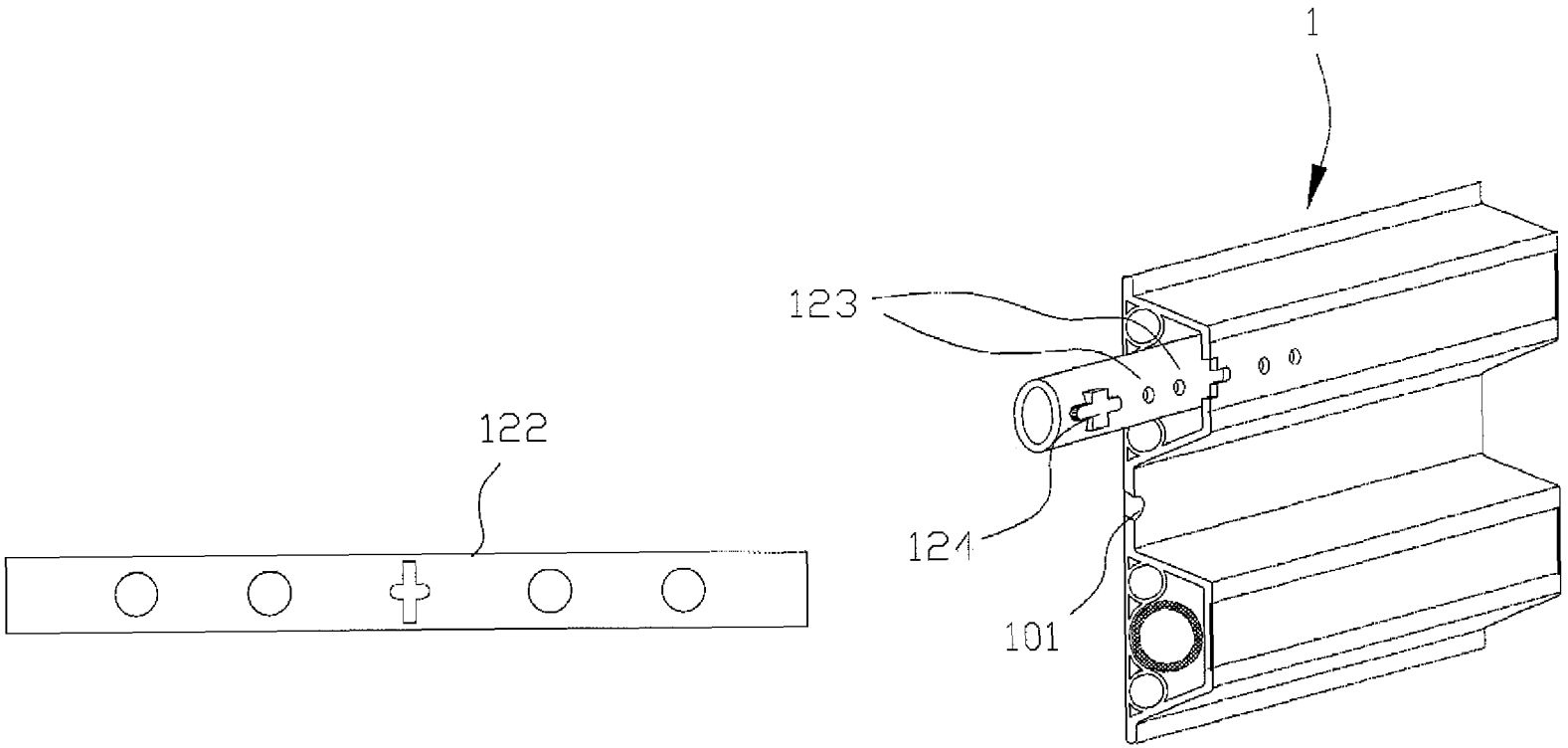
FIG. 6A is a perspective diagram illustrating the assembly of the barrier plate for highways according to another embodiment of the present invention.

With reference to FIG. 6, the M-shaped protective member 1, the saddle 2, and the support 3 are assembled together in turn so as to complete an illuminative and warning barrier plate for use in highways. As illustrated in FIG. 6A, for use on specific highways or mountain roads, the tubular member 122 is inserted into the M-shape protective member 1 and includes a number of perforated openings 123 and an intersected slot 124 arranged therearound so as to align the holes 101 with the intersected slot 124 by means of a crossed retainer, finishing the assembly.

Figure 7:
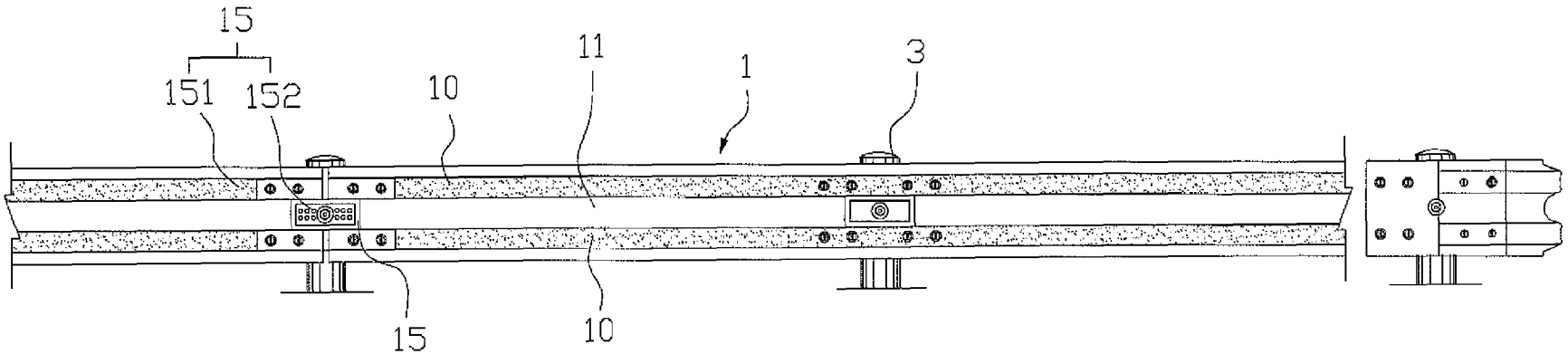
FIG. 7 is a plan diagram illustrating the operation of the barrier plate for highways according to the present invention.

Referring to FIG. 7, in another embodiment of the present invention, the support 3 is vertically inserted in the ground and then is affixed by using the clamping seats 31. Thereafter, the M-shape protective member 1 is assembled onto the support 3 by virtue of the saddle 2 and multiple screws, finishing a successive elongated barrier structure, head and distal ends of which are twisted in the shape of a semicircle, obtaining an anti-collision and shock-absorbing purpose. On the other hand, the adhesive warning tape 151 of the warning structure 15 may reflect light in dark conditions, achieving an illuminating and guiding purpose. At the joining portion of the M-shaped protective member 1 and the support 3 are arranged the LED light set 152 and the LED illumination set 153 of the warning structure 15, causing an illuminating and warning effect.

Besides, the power of the LED light set 152 or the LED illumination set 153 is supplied through the power line 141 in the third passage 14 of the M-shaped protective member 1. It is to be noted that the power line 141 may be also applied with small solar energy equipment, saving electricity.

It can be clearly seen from the preceding accounts on the features of the present invention that the barrier plate for highways of the present invention has the following advantages:

1. The M-shaped protective member and the saddle are made of ABS plastic material and integrally press formed, enabling recycling and decreasing reconstruction cost.

2. An assortment of colors and composite materials may be added during the press forming process, enhancing aesthetic appearance and beautifying environment.

3. Because the M-shaped protective member is made of ABS plastic material, having preferred flexibility, rigidity, weathering, anti-erosion, and lightweight. Moreover, since the insertion of the high tensile cord and the tubular member into the M-shaped protective member, car downfall on the specific highways or mountain roads may be effectively prevented.

4. The M-shape protective member may be provided to receive the optical fiber and the power line individually, lowering construction costs of optronics facilities on the highways.

5. The LED light set and the LED illumination set of the warning structure may be provided to generate an illuminating and warning effect.

6. The reflective agent may be replaceably applied onto the warning structure of the M-shaped protective member or the reflective sheet may be replaceably inlaid thereon, causing an illuminating and guiding effect.

The invention is not limited to the above embodiment but various modifications thereof may be made. It will be understood by those skilled in the art that various changes in form and detail may be made without departing from the scope and spirit of the present invention.

What is claimed is:

1. A barrier plate for highways comprising:

a M-shaped protective member made of plastic material and integrally press formed, and including a plurality of trapezoid and spaced projections and concaved planes, each of said projections having integrally formed and spaced first, second and third passages formed in the inner rim thereof and having a warning structure affixed on the outer periphery thereof;

a saddle, one side of which is joined with said M-shaped protective member by using a trapezoid elongated retaining portion, made of ABS plastic material and injection molded in the shape of a flat lamination, and including a plurality of corresponding bores provided on one side thereof and a recessed adhesive portion formed on another side thereof;

a support, one end of which is inserted in the ground yet another end of which cooperates with said adhesive portion of said saddle, retained by passing bolts through said M-shaped protective member.

2. The barrier plate for highways as claimed in claim 1, wherein during the press forming process of said M-shaped protective member, a variety of colors and composite materials are added therein.

3. The barrier plate for highways as claimed in claim 1, wherein said warning structure further has a LED light set and a LED illumination set arranged in different distance manner.

4. The barrier plate for highways as claimed in claim 1, wherein said M-shape protective member 1 further includes a tubular member received therein and having a number of perforated openings and an intersected slot arranged therearound.

5. The barrier plate for highways as claimed in claim 1, wherein said first passage may be provided to receive a high tensile cord therein.

6. The barrier plate for highways as claimed in claim 1, wherein said first passage may also be provided to receive a tubular member in which said high tensile cord is inserted.

7. The barrier plate for highways as claimed in claim 1, wherein said second passage is provided to receive an optical fiber therein.

8. The barrier plate for highways as claimed in claim 1, wherein said third passage is provided to receive a power line therein.

9. The barrier plate for highways as claimed in claim 1, wherein two ends of said M-shaped protective member may be constructed in the form of a semicircle.

10. The barrier plate for highways as claimed in claim 8, wherein said power line may be also applied with small solar energy equipment.

* * * * *